US012012129B2

(12) United States Patent
Du et al.

(10) Patent No.: US 12,012,129 B2
(45) Date of Patent: Jun. 18, 2024

(54) METHOD FOR TRAIN SUSPENSION CONTROL BY MEANS OF MULTIPLE AIR SPRINGS, SYSTEM FOR TRAIN SUSPENSION CONTROL BY MEANS OF MULTIPLE AIR SPRINGS, AND TRAIN

(71) Applicant: CRRC TANGSHAN CO., LTD., Hebei (CN)

(72) Inventors: Huijie Du, Tangshan (CN); Shujun Chen, Tangshan (CN); Zheng Liu, Tangshan (CN); Xinyong Zhang, Tangshan (CN); Zhonghua Liu, Tangshan (CN); Jiaying Qin, Tangshan (CN); Yongqin Yang, Tangshan (CN); Wenhao Hu, Tangshan (CN); Liangjie Li, Tangshan (CN); Limin Zhang, Tangshan (CN)

(73) Assignee: CRRC TANGSHAN CO., LTD., Hebei (CN)

( * ) Notice: Subject to any disclaimer, the term of this patent is extended or adjusted under 35 U.S.C. 154(b) by 917 days.

(21) Appl. No.: 17/047,956

(22) PCT Filed: May 9, 2018

(86) PCT No.: PCT/CN2018/086211
§ 371 (c)(1),
(2) Date: Oct. 15, 2020

(87) PCT Pub. No.: WO2019/200632
PCT Pub. Date: Oct. 24, 2019

(65) Prior Publication Data

US 2021/0163047 A1 Jun. 3, 2021

(30) Foreign Application Priority Data

Apr. 16, 2018 (CN) ..... 201810339939.9

(51) Int. Cl.
*B61F 5/14* (2006.01)
*B61F 1/14* (2006.01)
*B61F 5/24* (2006.01)

(52) U.S. Cl.
CPC ..... *B61F 5/144* (2013.01); *B61F 1/14* (2013.01); *B61F 5/24* (2013.01)

(58) Field of Classification Search
CPC ..... B61F 1/14; B61F 5/144; B61F 5/24
See application file for complete search history.

(56) References Cited

U.S. PATENT DOCUMENTS 9,340,217 B2 5/2016 Sato et al.
2015/0175176 A1 6/2015 Sato et al.

FOREIGN PATENT DOCUMENTS

CN 1555997 A 12/2004
CN 101045458 A * 10/2007 ..... B61F 5/10
(Continued)

OTHER PUBLICATIONS

Supplementary European Search Report in the European application No. 18915278.8, mailed on Jun. 24, 2021.
(Continued)

*Primary Examiner* — Robert J McCarry, Jr.
(74) *Attorney, Agent, or Firm* — Syncoda LLC; Feng Ma

(57) ABSTRACT

A method for train suspension control by means of multiple air springs includes: receiving a vehicle load pressure; and controlling height adjustment valves according to the vehicle load pressure to adjust the pressure of a first air spring set, a second air spring set and/or a third air spring set. Three height adjustment valves are provided, and the three height adjustment valves form a triangular structure. Each of the first air spring set, the second air spring set and the third air spring set comprises a plurality of individual air springs, and all the individual air springs in each of the air spring sets
(Continued)

are correspondingly connected to the same height adjustment valve. A system for train suspension control by means of multiple air springs and a train are further provided.

14 Claims, 9 Drawing Sheets

(56) References Cited

FOREIGN PATENT DOCUMENTS

| | | | | | |
|---|---|---|---|---|---|
| CN | 101045458 | A | | 10/2007 | |
| CN | 100436221 | C | | 11/2008 | |
| CN | 202071653 | U | | 12/2011 | |
| CN | 103568770 | A | | 2/2014 | |
| CN | 103640448 | A | | 3/2014 | |
| CN | 104912988 | A | | 9/2015 | |
| CN | 205168524 | U | * | 4/2016 | ..... B61F 5/24 |
| CN | 205168524 | U | | 4/2016 | |
| CN | 105620219 | A | | 6/2016 | |
| CN | 110641500 | A | | 1/2020 | |
| DE | 2830359 | A1 | | 1/1980 | |
| DE | 10353416 | A1 | | 6/2004 | |
| JP | 2000344099 | A | | 12/2000 | |
| RU | 2505439 | C2 | | 1/2014 | |

OTHER PUBLICATIONS

International Search Report in the international application No. PCT/CN2018/086211, mailed on Jan. 21, 2019.

English translation of the Written Opinion of the International Search Authority in the international application No. PCT/CN2018/086211, mailed on Jan. 21, 2019.

* cited by examiner

METHOD FOR TRAIN SUSPENSION CONTROL BY MEANS OF MULTIPLE AIR SPRINGS, SYSTEM FOR TRAIN SUSPENSION CONTROL BY MEANS OF MULTIPLE AIR SPRINGS, AND TRAIN

CROSS-REFERENCE TO RELATED APPLICATIONS

This application is a U.S. national stage of International Application No. PCT/CN2018/086211 filed on May 9, 2018, which claims priority to Chinese Patent Application No. 201810339939.9 filed on Apr. 16, 2018. The disclosures of these applications are hereby incorporated by reference in their entireties.

TECHNICAL FIELD

The disclosure relates to the technology of rail transportation, and particularly to a method and system for controlling a train suspension with multiple air springs, and a train.

BACKGROUND

In the actual operation of a train, passengers in carriages are not evenly distributed. In the area where the passengers are concentrated, air springs compress a lot, while in the area where the passengers are scarce, the air springs compress less. In order to prevent a train body from tilting, an air spring suspension control mode can be set in the train.

At present, each carriage of subways and high-speed trains is composed of two bogies 5, and each bogie 5 is provided with two air springs, so there are four air springs in each carriage. A control mode of an air spring suspension system is a two-point or four-point control mode.

In the air spring suspension control system using the two-point control mode, as shown in FIG. 1, each bogie 5 of a train is provided with one height adjusting valve 2. Air springs of two bogies 5 are connected directly. One height adjusting valve 2 controls two air springs of one bogie 5, and the other height adjusting valve 2 controls two air springs of the other bogie 5. Air is supplied to or exhausted from the air spring through a pipeline 3, so as to keep the train body in a stable state.

However, in the two-point control mode, the air springs at two sides of the bogie 5 are connected directly. It is ensured that the two sides of the bogie always have the same internal pressure, but this control mode cannot restrain a side-rolling movement of the train body, so it is needed to install a side-rolling resistant torsion bar between the bogie 5 and the train body to ensure its safety and reliability.

In the air spring suspension control system using the four-point control mode, as shown in FIG. 2, each bogie 5 of the train is provided with two height adjusting valves 2, and each height adjusting valve 2 controls one air spring. Air is supplied to or exhausted from the air spring through the pipeline 3. It is needed to install a differential pressure valve 4 between the air springs at two sides of the bogie 5. When the internal pressure difference between the air springs at the two sides exceeds a value, the differential pressure valve 4 is opened to balance the internal pressure of the air springs at the two sides and reduce a rate of wheel load reduction, so as to ensure that the train body will not overturn due to an excessive side-rolling angle.

Because left and right modules of the bogie 5 of the train may move independently in the four-point control mode, using the four-point control mode causes that four points are not coplanar, which causes the underside of the carriage and the bogie 5 to bear inconsistent forces. To some extent, the decoupling performance of the bogie 5 is affected and the adaptability of the train to the road is weakened.

For the problems in the two-point control mode and the four-point control mode, a three-point control mode is disclosed in the Chinese publication NO. CN100436221C, titled with "Height Adjusting Method and System for Air Spring Suspension System of Urban Railway Magnetic Levitated Train". However, in this three-point control mode, two sets of height adjusting mechanisms are adopted in the front-end marshaling process, one of the two set, as a redundancy, has a complex structure and complex control strategy, and increases the difficulty in installation of the bottom of the train.

SUMMARY

In view of this, embodiments of the disclosure provide a method and system for controlling a train suspension with multiple air springs, and a train.

To this end, technical solutions of the embodiments of the disclosure are implemented as follows.

A first aspect of the embodiments of the disclosure provides a method for controlling a train suspension with multiple air springs, which includes the following operations.

A train load pressure is received.

A pressure of a first air spring group, a pressure of a second air spring group and/or a pressure of a third air spring group are adjusted by controlling a height adjusting valve according to the train load pressure.

Three height adjusting valves are provided, and the three height adjusting valves form a triangular structure.

The first air spring group, the second air spring group and the third air spring group include a plurality of individual air springs, and all the individual air springs in each air spring group are correspondingly connected to a same height adjusting valve.

Preferably, a center of gravity of the triangular structure formed by the three height adjusting valves coincides with a center of gravity of a train baseplate.

Preferably, the first air spring group is on a left side of a front half of a train in a running direction of the train, the second air spring group is on a right side of the front half of the train in the running direction, and the third air spring group is in a rear half of the train in the running direction.

Preferably, the first air spring group is on a left side of a rear half of a train in a running direction of the train, the second air spring group is on a right side of the rear half of the train in the running direction, and the third air spring group is in a front half of the train in the running direction.

Preferably, a number of individual air springs in the first air spring group is the same as a number of individual air springs in the second air spring group.

Preferably, all the individual air springs in each air spring group are connected in series.

Preferably, the process that the pressure of the first air spring group, the pressure of the second air spring group and/or the pressure of the third air spring group are adjusted by controlling the height adjusting valve according to the train load pressure specifically includes the following operations.

The received train load pressure is compared with a preset pressure.

When the received train load pressure is greater than the preset pressure, the height adjusting valve is opened, and air is charged to the first air spring group, the second air spring group and/or the third air spring group.

When a pressure of the individual air springs in the first air spring group, the second air spring group and the third air spring group is equal to the train load pressure, the height adjusting valve is closed, and charging air is stopped.

Preferably, the process that the pressure of the first air spring group, the pressure of the second air spring group and/or the pressure of the third air spring group are adjusted by controlling the height adjusting valve according to the train load pressure specifically includes the following operations.

The received train load pressure is compared with a preset pressure.

When the received train load pressure is greater than the preset pressure, an opening degree of the height adjusting valve is controlled, and air is charged to the first air spring group, the second air spring group and/or the third air spring group at a first rate.

When the pressure of the individual air springs in the first air spring group, the second air spring group and/or the third air spring group is less than the train load pressure, and a difference between the pressure of the individual air springs and the train load pressure is equal to a preset difference, the opening degree of the height adjusting valve is controlled, and air is charged to the first air spring group, the second air spring group and/or the third air spring group at a second rate.

When the pressure of the individual air springs in the first air spring group, the second air spring group and the third air spring group is equal to the train load pressure, the height adjusting valve is closed, and charging air is stopped.

A second aspect of the embodiments of the disclosure provides a system for controlling a train suspension with multiple air springs. The system includes a first height adjusting valve, a second height adjusting valve, a third height adjusting valve and an air channel control device.

The first height adjusting valve, the second height adjusting valve and the third height adjusting valve are correspondingly connected to individual air springs in the first air spring group, the second air spring group and the third air spring group respectively. The first height adjusting valve, the second height adjusting valve and the third height adjusting valve form a triangular structure.

The air channel control device includes a processor. The processor is configured with operation instructions executable by the processor, to perform the following operations.

The train load pressure is received.

A pressure of the first air spring group, a pressure of the second air spring group and/or a pressure of the third air spring group is correspondingly adjusted by controlling the first height adjusting valve, the second height adjusting valve and/or the third height adjusting valve according to the train load pressure.

Preferably, a center of gravity of the triangular structure formed by the first height adjusting valve, the second height adjusting valve and the third height adjusting valve coincides with a center of gravity of the train baseplate.

Preferably, the first air spring group is on a left side of a front half of a train in a running direction of the train, the second air spring group is on a right side of the front half of the train in the running direction, and the third air spring group is in a rear half of the train in the running direction.

Preferably, the first air spring group is on a left side of a rear half of a train in a running direction of the train, the second air spring group is on a right side of the rear half of the train in the running direction, and the third air spring group is in a front half of the train in the running direction.

Preferably, a number of individual air springs in the first air spring group is the same as a number of individual air springs in the second air spring group.

Preferably, all the individual air springs in each air spring group are connected in series.

Preferably, the air channel control device includes a processor. The processor is configured with operation instructions executable by the processor, to perform the following operations.

The received train load pressure is compared with a preset pressure.

When the received train load pressure is greater than the preset pressure, the first height adjusting valve, the second height adjusting valve and/or the third height adjusting valve is opened, and air is charged to the first air spring group, the second air spring group and/or the third air spring group.

When a pressure of the individual air springs in the first air spring group, the second air spring group and the third air spring group is equal to the train load pressure, the first height adjusting valve, the second height adjusting valve and the third height adjusting valve are closed, and charging air is stopped.

Preferably, the processor is configured with operation instructions executable by the processor, to perform the following operations.

The received train load pressure is compared with a preset pressure.

When the received train load pressure is greater than the preset pressure, an opening degree of the first height adjusting valve, the second height adjusting valve and/or the third height adjusting valve is controlled, and air is charged to the first air spring group, the second air spring group and/or the third air spring group at a first rate.

When a pressure of the individual air springs in the first air spring group, the second air spring group and/or the third air spring group is less than the train load pressure, and a difference between the pressure of the individual air springs and the train load pressure is equal to a preset difference, the opening degree of the first height adjusting valve, the second height adjusting valve and/or the third height adjusting valve is controlled, and air is charged to the first air spring group, the second air spring group and/or the third air spring group at a second rate.

When the pressure of the individual air springs in the first air spring group, the second air spring group and the third air spring group is equal to the train load pressure, the first height adjusting valve, the second height adjusting valve and the third height adjusting valve are closed, and charging air is stopped.

Preferably, a pressure reducing valve is provided between the air channel control device and the first height adjusting valve, the second height adjusting valve and the third height adjusting valve to stabilize pressures at air inlets of the first height adjusting valve, the second height adjusting valve and the third height adjusting valve.

A third aspect of the embodiments of the disclosure provides a train. The train includes the system for controlling a train suspension with multiple air springs described in the second aspect of the embodiments of the disclosure.

The beneficial effect of the disclosure are as follows: in the disclosure, a plurality of air springs on the train are divided into three groups, and the pressure is controlled by means of three height adjusting valves, meanwhile, the three height adjusting valves are always kept on the same plane, so that a floor of a carriage and a bogie bear the same force.

Side rolling, back sitting, nodding and so on will not occur. The disclosure makes a train load distribution more reasonable, so as to improve the performance of the train adapting to the curve of track.

BRIEF DESCRIPTION OF THE DRAWINGS

The accompanying drawings described here are used for providing further understanding of the disclosure, and constitute a part of the disclosure. Schematic embodiments of the disclosure and description thereof are used for illustrating the disclosure and not intended to form an improper limit to the disclosure. In the accompanying drawings.

Figure 1:
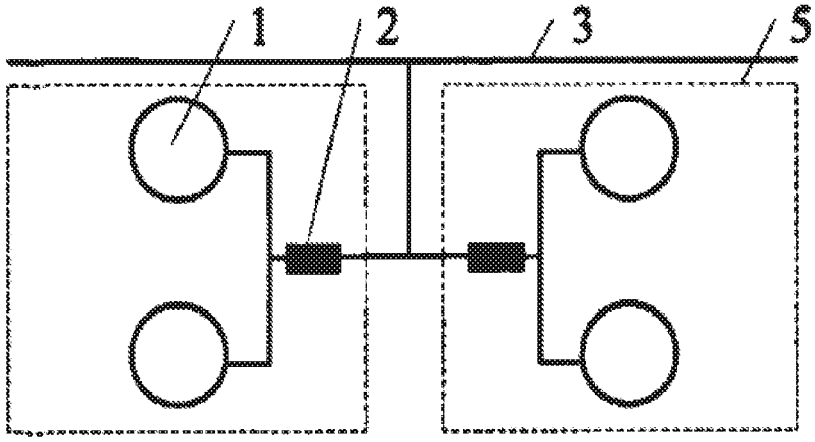
FIG. 1 (PRIOR ART)
FIG. 1 is a principle diagram of the two-point control mode in the prior art.
Figure 2:
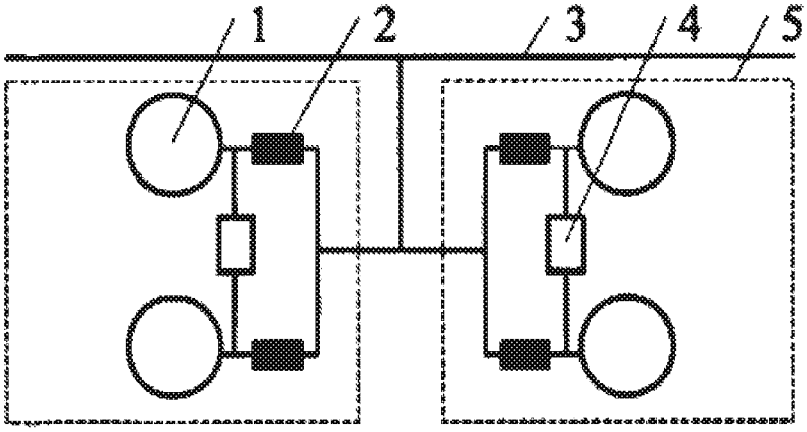
FIG. 2 (PRIOR ART)
FIG. 2 is a principle diagram of the four-point control mode in the prior art.

Reference numerals are listed as follows:

1. Individual air spring; 2. Height adjusting valve; 3. Pipeline; 4. Differential pressure valve; 5. Bogie; 6. First height adjusting valve; 7. Second height adjusting valve; 8. Third height adjusting valve; 9. First support; 10. Adjustable connecting rod; 11. Second support; and 12. Pressure reducing valve.

DETAILED DESCRIPTION

In order to make the technical solutions and advantages in embodiments of the disclosure clearer, the exemplary embodiments in the disclosure are further elaborated below in combination with the accompanying drawings. It is apparent that the described embodiments are only a part of the embodiments of the disclosure but not an exhaustive list of all embodiments. It is to be noted that the embodiments in the application and characteristics in the embodiments may be combined without conflicts.

First Embodiment

Figure 3:
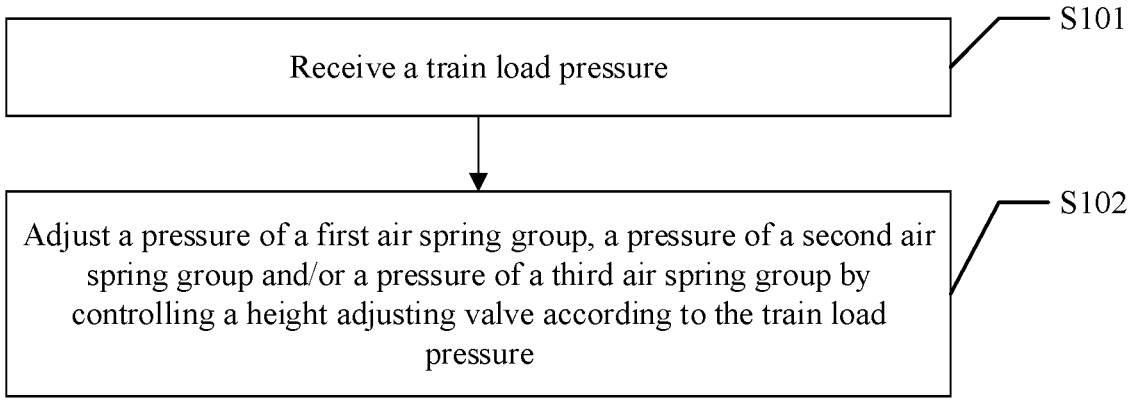
FIG. 3 is a flowchart of a method for controlling a train suspension with multiple air springs according to a first embodiment of the disclosure.

As shown in FIG. 3, the present embodiment provides a method for controlling a train suspension with multiple air springs. The method includes the following operations.

A train load pressure is received.

A pressure of a first air spring group, a pressure of a second air spring group and/or a pressure of a third air spring group are/is adjusted by controlling a height adjusting valve according to the train load pressure.

Specifically, three height adjusting valves are provided in the embodiment, and the three height adjusting valves form a triangular structure.

The first air spring group, the second air spring group and the third air spring group each include a plurality of individual air springs 1, and all the individual air springs 1 in each of the air spring groups are correspondingly connected to a same height adjusting valve.

More specifically, taking a magnetically levitated train with five carriages as an example, there are a total of ten bogies 5, and two individual air springs 1 are arranged on each bogie 5, so there are a total of twenty individual air springs 1. The twenty individual air springs 1 are divided into three groups. The present embodiment provides the following two grouping modes.

(1) The first air spring group is on a left side of a front half of a train in a running direction of the train, the second air spring group is on a right side of the front half of the train in the running direction, and the third air spring group is in a rear half of the train in the running direction.

(2) The first air spring group is on a left side of a rear half of a train in a running direction of the train, the second air spring group is on a right side of the rear half of the train in the running direction, and the third air spring group is in a front half of the train in the running direction.

The air spring control principles of the above two grouping modes are exactly the same, and the goals are also the same. Taking the first grouping mode as an example, an illustration is given below.

Figure 4:
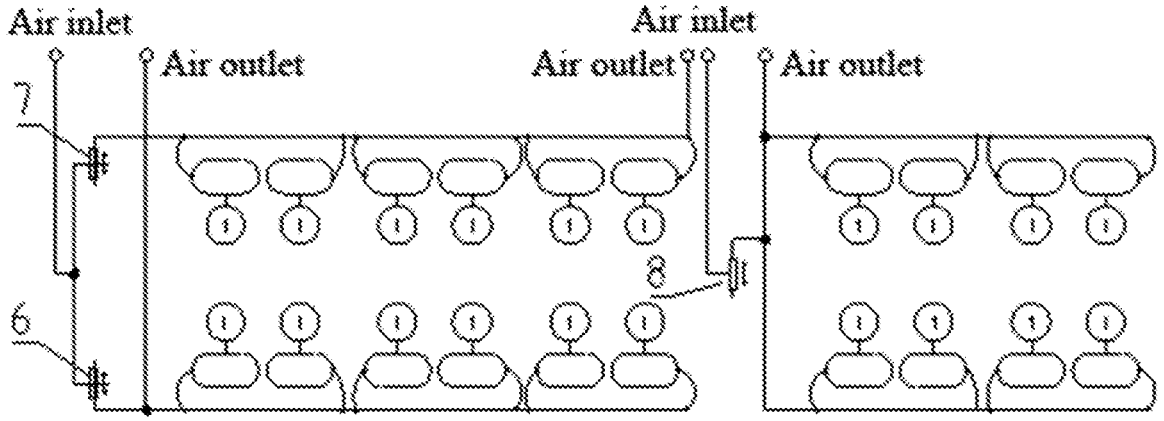
FIG. 4 is a schematic diagram of a grouping according to an embodiment of the disclosure.

FIG. 4 is the first grouping mode of individual air springs according to the present embodiment. All the air springs at a bottom of each carriage are divided into three groups: a front left group, a front right group and a rear group. Each of the front left group (the first air spring group) and the front right group (the second air spring group) has six air springs. The rear group (the third air spring group) has four air springs at left side and four air springs at right side.

The three groups of individual air springs 1 are independent from each other and do not communicate with each other. There is no need to set a differential pressure valve 4. The individual air springs 1 in each air spring group are connected in series to ensure that each air spring group always has the same internal pressure, which can fast charge air to and exhaust air from the individual air springs 1.

Figure 5:
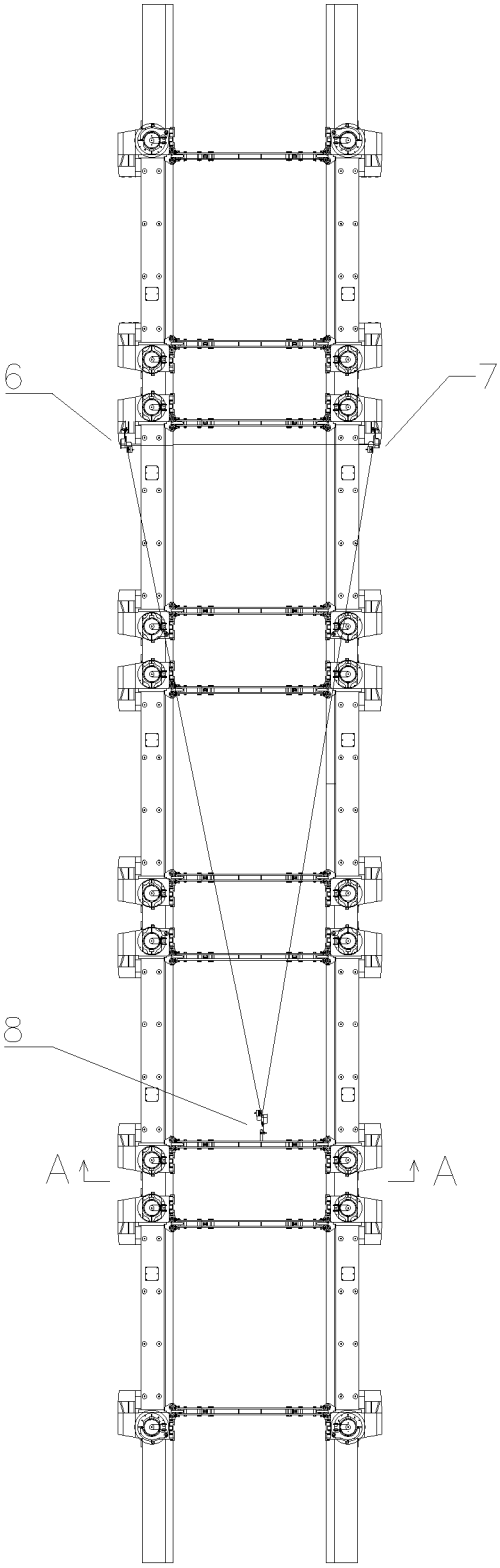
FIG. 5 is a location diagram of a height adjusting valve according to an embodiment of the disclosure.
Figure 6:
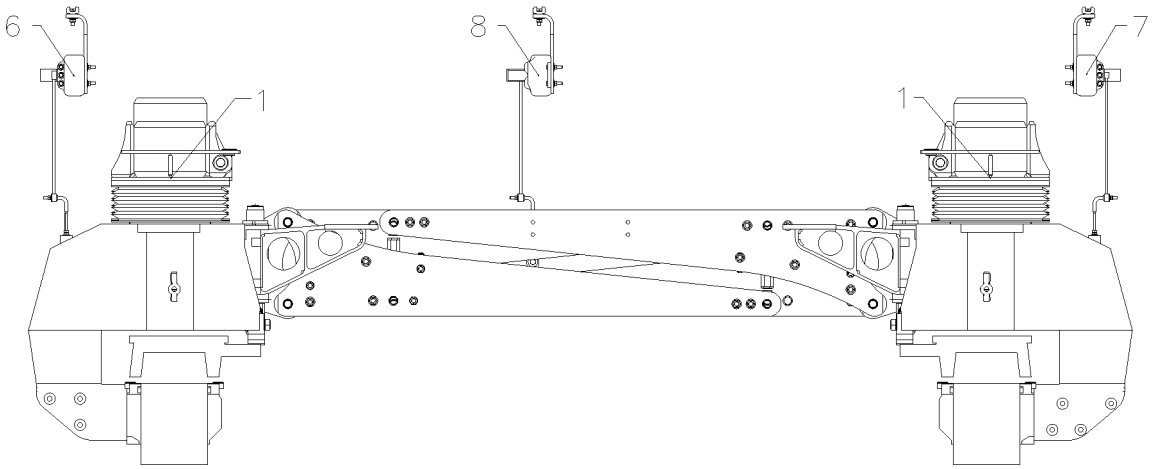
FIG. 6 is a section view taken from the line A-A of FIG. 5.

The individual air springs 1 in each air spring group are simultaneously connected to the same height adjusting valve. A first height adjusting valve 6 connected to the first air spring group and a second height adjusting valve 7 connected to the second air spring group are installed on a second bogie to respectively control six air springs at the left and right sides. A third height adjusting valve 8 connected to the third air spring group is installed on the fourth bogie to control the rest eight air springs. As shown in FIG. 5 and FIG. 6, the first height adjusting valve 6, the second height adjusting valve 7 and the third height adjusting valve 8 form an isosceles triangle structure. A center of gravity of the isosceles triangle structure coincides with a center of gravity of a train baseplate, which can ensure that three points regarding the first height adjusting valve 6, the second height adjusting valve 7 and the third height adjusting valve 8 are always in a plane, so that an underside of a carriage and the bogie 5 bear the same force. In this way, a side-rolling movement of the train body can be restrained to ensure the balance of the train body, and avoid side rolling, back sitting, nodding and so on, thus improving the safety and reliability in running of the train.

Figure 7:
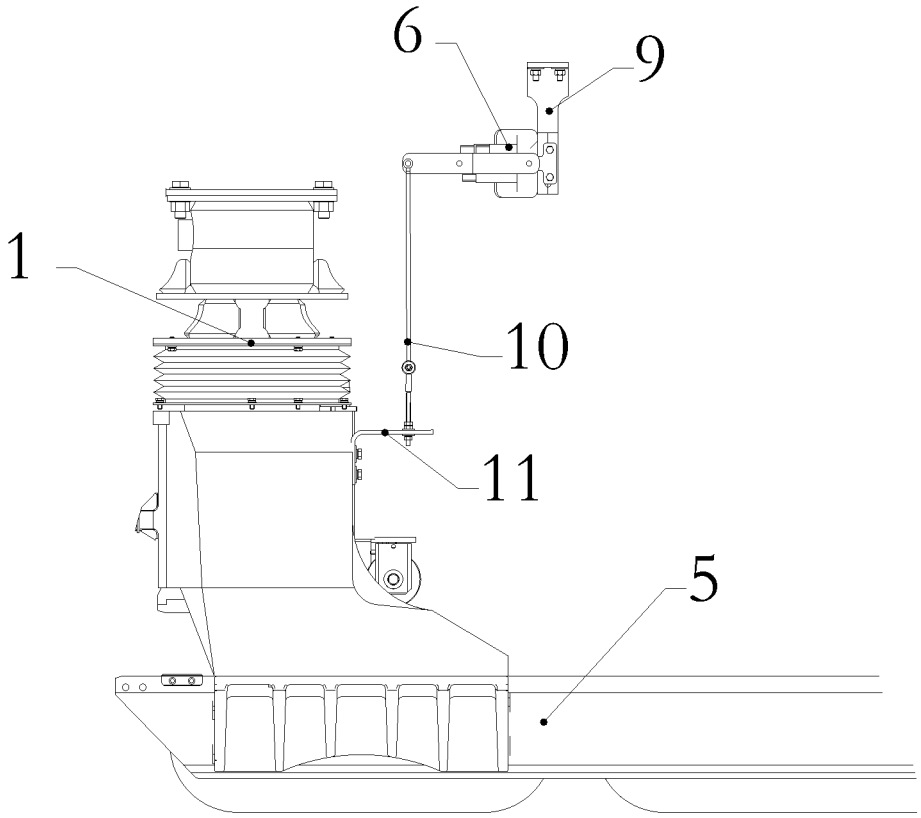
FIG. 7 is a schematic diagram of installation between a height adjusting valve and an individual air spring 1 according to an embodiment of the disclosure.

As shown in FIG. 7, one end of the height adjusting valve in the present embodiment is fixedly connected with the train body through a first support 9, the other end of the height adjusting valve is provided with an adjustable connecting rod 10, a second support 11 is connected at the bottom of the adjustable connecting rod 10, and the second support 11 is fixedly connected with the individual air spring 1. The adjustable connecting rod 10 can be adjusted in angle and length, so that a reliable connection between the height adjusting valve and the individual air spring 1 can be ensured no matter what state the bogie 5 is in.

Further, in the present embodiment, the process that the pressure of the first air spring group, the pressure of the second air spring group and/or the pressure of the third air spring group are/is adjusted by controlling the height adjusting valve according to the train load pressure specifically includes the following operations.

The received train load pressure is compared with a preset pressure.

When the received train load pressure is greater than the preset pressure, the height adjusting valve is opened, and air is charged to the first air spring group, the second air spring group and/or the third air spring group.

When a pressure of the individual air springs 1 in the first air spring group, the second air spring group and the third air spring group is equal to the train load pressure, the height adjusting valve is closed, and charging air is stopped.

Specifically, when the train load is increased, the train body moves down relative to the bogie 5, then the height adjusting valve is opened; a lever of the height adjusting valve rotates upward around a driving shaft to charge air to the air spring, so that the pressure of the air spring is increased and the train body is raised. When the pressure of the air spring is balanced with the train load, the height adjusting valve is closed to stop charging air.

Further, in the present embodiment, the process that the pressure of the first air spring group, the pressure of the second air spring group and/or the pressure of the third air spring group are adjusted by controlling the height adjusting valve according to the train load pressure specifically includes the following operations.

The received train load pressure is compared with a preset pressure.

When the received train load pressure is greater than the preset pressure, an opening degree of the height adjusting valve is controlled, and air is charged to the first air spring group, the second air spring group and/or the third air spring group at a first rate.

When a pressure of the individual air springs 1 in the first air spring group, the second air spring group and/or the third air spring group is less than the train load pressure, and a difference between the pressure of the individual air springs 1 and the train load pressure is equal to a preset difference, the opening degree of the height adjusting valve is controlled, and air is charged to the first air spring group, the second air spring group and/or the third air spring group at a second rate.

When the pressure of the individual air springs 1 in the first air spring group, the second air spring group and the third air spring group is equal to the train load pressure, the height adjusting valve is closed, and charging air is stopped.

Specifically, when the train load becomes from a no-load state to an overload state, the opening degree of the height adjusting valve is the largest, an external empty spring air supply cylinder rapidly charges air to the air spring through a high-speed adjusting valve. When the pressure of the air springs is close to the train load, the train body moves upward again, so the opening degree of the height adjusting valve gradually decreases to charge air to the air springs at a low speed until the pressure of the air springs is balanced with the train load.

Figure 8:
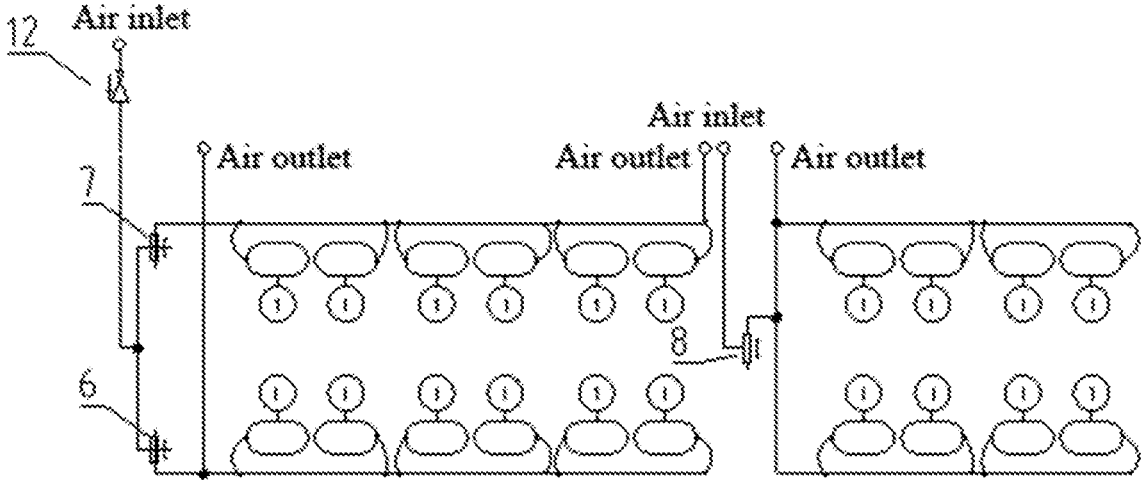
FIG. 8 is a schematic diagram of an installation location of a pressure reducing valve 12 according to an embodiment of the disclosure.

In addition, as shown in FIG. 8, a pressure reducing valve 12 may be set at air inlets of the three air spring groups to stabilize pressures at the air inlets of the three air spring groups, and a throttle valve is not required for each height adjusting valve, so a control strategy is simplified. The pressure setting of the pressure reducing valve 12 can meet a working requirement of the train under extreme loads.

In an actual process of traffic operation, it is found that when a magnetically levitated train goes through a convex-concave vertical curve, because the bogie 5 is distributed in a polyline along a track, the heights of ten air springs at each side are inconsistent, and even several air spring groups lose pressure, resulting in the inconsistency of the carriage pressure on two ends of the bogie 5, which will cause a support force of a suspended electromagnet to change greatly. In the method provided by the present embodiment, when a certain suspended electromagnet fails, because the underside of the carriage is completely parallel to a plane controlled by the three height adjusting valves, it can be guaranteed that this bogie 5 does not bear the weight of the train body, and the weight can be distributed to other bogies 5, thereby improving the performance of the train going through the vertical curve.

Second Embodiment

Figure 9:
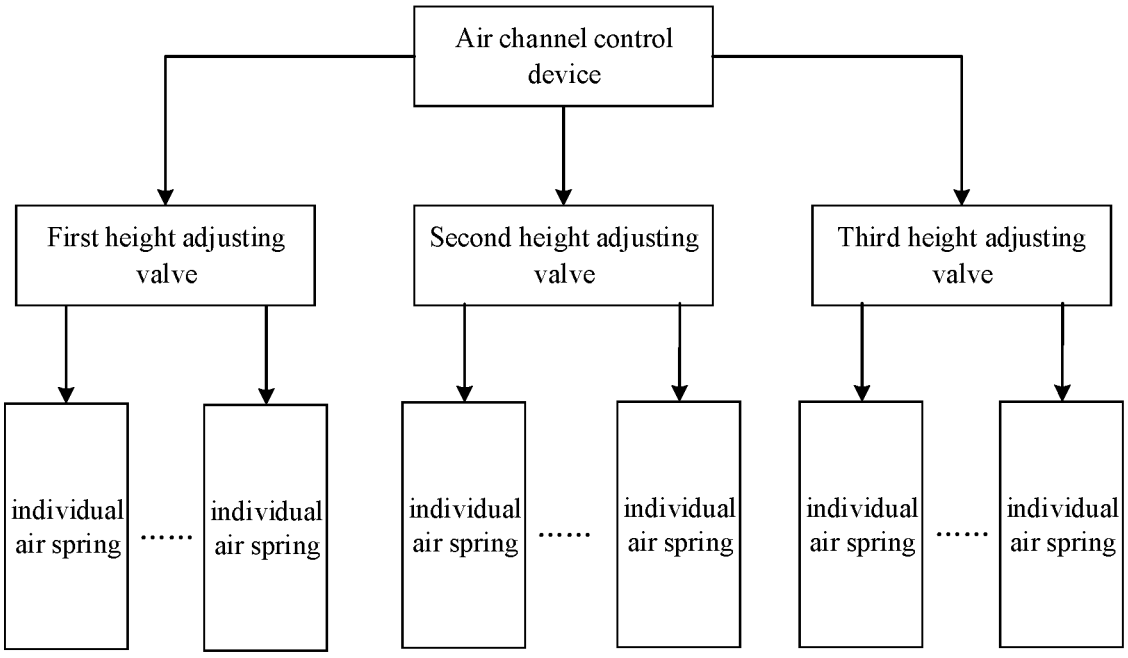
FIG. 9 is a principle diagram of a system for train suspension control by means of multiple air springs according to a second embodiment of the disclosure.

Corresponding to the method for controlling the train suspension with multiple air springs in the first embodiment, the present embodiment provides a system for controlling a train suspension with multiple air springs. As shown in FIG. 9, the system includes: a first height adjusting valve 6, a second height adjusting valve 7, a third height adjusting valve 8 and an air channel control device.

The first height adjusting valve 6, the second height adjusting valve 7 and the third height adjusting valve 8 are correspondingly connected to individual air springs 1 in the first air spring group, the second air spring group and the third air spring group respectively. The first height adjusting valve 6, the second height adjusting valve 7 and the third height adjusting valve 8 form a triangular structure.

The air channel control device includes a processor. The processor is provided with operation instructions executable by the processor to perform the following operations.

A train load pressure is received.

A pressure of the first air spring group, a pressure of the second air spring group and/or a pressure of the third air spring group are adjusted correspondingly by controlling the first height adjusting valve 6, the second height adjusting valve 7 and/or the third height adjusting valve 8 according to the train load pressure.

The specific operation process in the system for controlling the train suspension with multiple air springs provided by the present embodiment can be referred to the content described in the first embodiment, which will not be repeated here.

Third Embodiment

The present embodiment provides a train. The train includes a system for controlling a train suspension with multiple air springs provided by the second embodiment.

One end of the height adjusting valve in the system for controlling the train suspension with multiple air springs is fixedly connected with the train body through the first support 9, the other end of the height adjusting valve is provided with the adjustable connecting rod 10, the second support 11 is connected at the bottom of the adjustable connecting rod 10, and the second support 11 is fixedly connected with the individual air spring 1. The adjustable connecting rod 10 can be adjusted in angle and length, so that a reliable connection between the height adjusting valve and the individual air spring 1 can be ensured no matter what state the bogie 5 is in.

In the present embodiment, a plurality of air springs on the train are divided into three groups, and the pressure is controlled by means of three height adjusting valves, meanwhile, the three height adjusting valves are always kept on the same plane, so that the underside of the carriage and the bogie 5 bear the same force. Side rolling, back sitting, nodding and so on will not occur. The disclosure makes the train load distribution more reasonable, so as to improve the performance of the train adapting to a curve of track.

Those skilled in the art should understand that the embodiments of the disclosure may be provided as a method, a system or a computer program product. Thus, the disclosure may adopt forms of complete hardware embodiments, complete software embodiments or embodiments integrating software and hardware. Moreover, the disclosure may adopt the form of a computer program product implemented on one or more computer available storage media (including, but not limited to, a disk memory, a CD-ROM, an optical memory and the like) containing computer available program codes.

The disclosure is described with reference to flowcharts and/or block diagrams of the method, the device (system) and the computer program product according to the embodiments of the disclosure. It should be understood that each flow and/or block in the flowchart and/or block diagram, and the combination of the flow and/or block in the flowchart and/or block diagram can be implemented by the computer program instructions. These computer program instructions can be provided to a processor of a general-purpose computer, a special-purpose computer, an embedded processor or other programmable data processing devices to generate a machine, so that instructions which are executed by the processor of the computer or other programmable data processing devices generate a device which is used for implementing the specified functions in one or more flows of the flowchart and/or one or more blocks of the block diagram.

These computer program instructions may also be stored in the computer-readable memory which can guide the computer or other programmable data processing devices to operate in a particular way, so that the instructions stored in the computer-readable memory generate a product including an instruction device. The instruction device implements the specified functions in one or more flows of the flowchart and/or one or more blocks of the block diagram.

These computer program instructions may also be loaded on the computer or other programmable data processing devices, so that a series of operation steps are performed on the computer or other programmable data processing devices to generate the processing implemented by the computer, and the instructions executed on the computer or other programmable devices provide the steps for implementing the specified functions in one or more flows of the flowchart and/or one or more blocks of the block diagram.

Although preferred embodiments of the disclosure have been described, those skilled in the art can make additional changes and modifications to the embodiments once knowing a basic creativity concept. Therefore, the appended claims are intended to be interpreted as including the preferred embodiments and all the changes and modifications falling within the scope of the disclosure.

It is apparent that those skilled in the art can make various modifications and variations to the disclosure without departing from the spirit and scope of the disclosure. Thus, if such modifications and variations of the disclosure fall within the scope of the appended claims and their equivalents, the disclosure is also intended to cover the modifications and variations.

The invention claimed is:

1. A method for controlling a train suspension with multiple air springs, comprising:

receiving a train load pressure; and adjusting at least one of a pressure of a first air spring group, a pressure of a second air spring group or a pressure a third air spring group by controlling a height adjusting valve according to the train load pressure;

wherein three height adjusting valves are provided, and the three height adjusting valves are distributed at three vertexes of a triangle respectively;

the first air spring group, the second air spring group and the third air spring group comprise a plurality of individual air springs, and all the individual air springs in each air spring group are correspondingly connected to a same height adjusting valve, wherein a train is composed of a plurality of carriages, and all of the individual air springs in bogies of the carriages are divided into the first air spring group, the second air spring group, and the third air spring group, the number of individual air springs in the first air spring group is the same as the number of individual air springs in the second air spring group, and the first air spring group and the second air spring group are located on both sides of the train along a running direction of the train respectively, and a center of gravity of the triangle coincides with a center of gravity of a baseplate of the train.

2. The method of claim 1, wherein the first air spring group is on a left side of a front half of a train in the running direction of the train, the second air spring group is on a right side of the front half of the train in the running direction, and the third air spring group is in a rear half of the train in the running direction.

3. The method of claim 1, wherein the first air spring group is on a left side of a rear half of a train in the running direction of the train, the second air spring group is on a right side of the rear half of the train in the running direction, and the third air spring group is in a front half of the train in the running direction.

4. The method of claim 1, wherein all the individual air springs in each air spring group are connected in series.

5. The method of claim 1, wherein the process of adjusting at least one of the pressure of the first air spring group, the pressure of the second air spring group or the pressure of the third air spring group by controlling the height adjusting valve according to the train load pressure specifically comprises:

comparing the received train load pressure with a preset pressure;

when the received train load pressure is greater than the preset pressure, opening the height adjusting valve, and charging air to at least one of the first air spring group, the second air spring group or the third air spring group; and when a pressure of the individual air springs in the first air spring group, the second air spring group and the third air spring group is equal to the train load pressure, closing the height adjusting valve, and stopping charging air.

6. The method of claim 1, wherein the process of adjusting at least one of the pressure of the first air spring group, the pressure of the second air spring group or the pressure of the third air spring group by controlling the height adjusting valve according to the train load pressure specifically comprises:

comparing the received train load pressure with a preset pressure;

when the received train load pressure is greater than the preset pressure, controlling an opening degree of the height adjusting valve, and charging air to at least one of the first air spring group, the second air spring group or the third air spring group at a first rate;

when a pressure of the individual air springs in at least one of the first air spring group, the second air spring group or the third air spring group is less than the train load pressure, and a difference between the pressure of the individual air springs and the train load pressure is equal to a preset difference, controlling the opening degree of the height adjusting valve, and charging air to at least one of the first air spring group, the second air spring group or the third air spring group at a second rate;

when the pressure of the individual air springs in the first air spring group, the second air spring group and the third air spring group is equal to the train load pressure, closing the height adjusting valve, and stopping charging air.

7. A system for controlling a train suspension with multiple air springs, comprising: a first height adjusting valve, a second height adjusting valve, a third height adjusting valve and an air channel control device; wherein the first height adjusting valve, the second height adjusting valve and the third height adjusting valve are correspondingly connected to individual air springs in a first air spring group, a second air spring group and a third air spring group respectively, and the first height adjusting valve, the second height adjusting valve and the third height adjusting valve are distributed at three vertexes of a triangle respectively;

the air channel control device comprises a processor; the processor is configured with operation instructions executable by the processor to perform the following operations:

receiving a train load pressure; and correspondingly adjusting at least one of a pressure of the first air spring group, a pressure of the second air spring group or a pressure of the third air spring group by controlling at least one of the first height adjusting valve, the second height adjusting valve or the third height adjusting valve according to the train load pressure, wherein a train is composed of a plurality of carriages, and all of the individual air springs in bogies of the carriages are divided into the first air spring group, the second air spring group, and the third air spring group, the number of individual air springs in the first air spring group is the same as the number of individual air springs in the second air spring group, and the first air spring group and the second air spring group are located on both sides of the train along a running direction of the train respectively, and a center of gravity of the triangle coincides with a center of gravity of a baseplate of the train.

8. The system of claim 7, wherein the first air spring group is on a left side of a front half of a train in the running direction of the train, the second air spring group is on a right side of the front half of the train in the running direction, and the third air spring group is in a rear half of the train in the running direction.

9. The system of claim 7, wherein the first air spring group is on a left side of a rear half of a train in the running direction of the train, the second air spring group is on a right side of the rear half of the train in the running direction, and the third air spring group is in a front half of the train in the running direction.

10. The system of claim 7, wherein all the individual air springs in each air spring group are connected in series.

11. The system of claim 7, wherein the processor is configured with operation instructions executable by the processor, to perform the following operations:

comparing the received train load pressure with a preset pressure;

when the received train load pressure is greater than the preset pressure, opening at least one of the first height adjusting valve, the second height adjusting valve or the third height adjusting valve, and charging air to at least one of the first air spring group, the second air spring group or the third air spring group;

when a pressure of the individual air springs in the first air spring group, the second air spring group and the third air spring group is equal to the train load pressure, closing the first height adjusting valve, the second height adjusting valve and the third height adjusting valve, and stopping charging air.

12. The system of claim 7, wherein the processor is configured with operation instructions executable by the processor, to perform the following operations:

comparing the received train load pressure with a preset pressure;

when the received train load pressure is greater than the preset pressure, controlling an opening degree of at least one of the first height adjusting valve, the second height adjusting valve or the third height adjusting valve, and charging air to at least one of the first air spring group, the second air spring group or the third air spring group at a first rate;

when an pressure of the individual air springs in at least one of the first air spring group, the second air spring group or the third air spring group is less than the train load pressure, and a difference between the pressure of the individual air springs and the train load pressure is equal to a preset difference, controlling the opening degree of at least one of the first height adjusting valve, the second height adjusting valve or the third height adjusting valve, and charging air to at least one of the first air spring group, the second air spring group or the third air spring group at a second rate; and when the pressure of the individual air springs in the first air spring group, the second air spring group and the third air spring group is equal to the train load pressure, closing the first height adjusting valve, the second height adjusting valve and the third height adjusting valve, and stopping charging air.

13. The system of claim 7, wherein a pressure reducing valve is provided between the air channel control device and the first height adjusting valve, the second height adjusting valve and the third height adjusting valve to stabilize pressures at air inlets of the first height adjusting valve, the second height adjusting valve and the third height adjusting valve.

14. A train, comprising a system for controlling a train suspension with multiple air springs, the system comprising: a first height adjusting valve, a second height adjusting valve, a third height adjusting valve and an air channel control device; wherein the first height adjusting valve, the second height adjusting valve and the third height adjusting valve are correspondingly connected to individual air springs in a first air spring group, a second air spring group and a third air spring group respectively, and the first height adjusting valve, the second height adjusting valve and the third height adjusting valve are distributed at three vertexes of a triangle respectively;

the air channel control device comprises a processor; the processor is configured with operation instructions executable by the processor to perform the following operations:

receiving a train load pressure; and correspondingly adjusting at least one of a pressure of the first air spring group, a pressure of the second air spring group or a pressure of the third air spring group by controlling at least one of the first height adjusting valve, the second height adjusting valve or the third height adjusting valve according to the train load pressure, wherein the train is composed of a plurality of carriages, and all of the individual air springs in bogies of the carriages are divided into the first air spring group, the second air spring group, and the third air spring group, the number of individual air springs in the first air spring group is the same as the number of individual air springs in the second air spring group, and the first air spring group and the second air spring group are located on both sides of the train along a running direction of the train respectively, and a center of gravity of the triangle coincides with a center of gravity of a baseplate of the train.

* * * * *